US005647417A

United States Patent [19]

Schaefer et al.

[11] Patent Number: 5,647,417

[45] Date of Patent: Jul. 15, 1997

[54] LONG-TIMBER CHIPPING MACHINE

[75] Inventors: Karl Schaefer, Lechbruck, Germany; Gerd Schaefer, St. Nom-la-Breteche, France

[73] Assignee: Inter-Wood-Maschinen GmbH & Co., KG, Lechbruck am See, Germany

[21] Appl. No.: 585,605

[22] Filed: Jan. 16, 1996

[30] Foreign Application Priority Data

Jan. 14, 1995 [DE] Germany ..... 195 00 960.6

[51] Int. Cl.[6] ..... B27C 1/00; B27L 11/00

[52] U.S. Cl. ..... 144/172; 144/162.1; 144/242.1; 144/373; 144/174; 241/92

[58] Field of Search ..... 241/92; 144/162.1, 144/172, 173, 174, 373, 242.1, 245.1

[56] References Cited

U.S. PATENT DOCUMENTS

| | | | |
|---|---|---|---|
| 3,913,643 | 10/1975 | Lambert | 144/172 |
| 4,583,574 | 4/1986 | Pallmann | 144/172 |
| 4,784,198 | 11/1988 | Pallmann | 144/172 |
| 5,070,918 | 12/1991 | Pallmann | 144/172 |

FOREIGN PATENT DOCUMENTS

| | | |
|---|---|---|
| 2542340 | 7/1976 | Germany . |
| 4335348 | 6/1994 | Germany . |

*Primary Examiner*—W. Donald Bray
*Attorney, Agent, or Firm*—Foley & Lardner

[57] ABSTRACT

A long-timber chipping machine has a timber feed channel for receiving longitudinally arranged timbers, advanced using a timber-advancing device to a vertically movable chipping device positioned at the downstream end of the feed channel. The chipping device has a rotatable cutter ring equipped with chipping cutters on its cylindrical inner wall, which defines a chipping chamber. The chamber is aligned with the downstream end of the feed channel. To improve the chipping, a curved timber-receiving plate projects into the chipping chamber from the downstream end of the feed channel, which also has a matching curved base. The curvature of the plate and the base match the curvature of upper cylindrical inner wall of the cutter ring so that the upper cylindrical inner wall can be lowered closely to the plate, leaving only a very small clearance and exposing all of the timbers to the chipping cutters. To better guide the timbers into the chipping chamber, the chipping device includes two vertical side walls attached to the housing that shields the chipper ring. These side walls extend into the chipping chamber and spaced apart so that the plate is positioned between the side walls and allow the side walls to move as the chipping device is vertically displaced.

18 Claims, 3 Drawing Sheets

LONG-TIMBER CHIPPING MACHINE

BACKGROUND OF THE INVENTION

Wood chips can be mass produced with a long-timber chipping machine, as described for example in the present assignee's German patent publication DE 43 35 348 (hereafter the "first Publication"). Here, the chipping machine includes a timber feed channel for receiving timbers to be chipped in a longitudinally arranged form and includes a timber-advancing device for feeding the longitudinally arranged timbers to a chipping tool or device positioned at the downstream end of the feed channel. The chipping device includes a rotatable cutter ring, the cylindrical inner wall thereof defining a chipping chamber, which is aligned with the feed-channel downstream end. The cutter-ring inner wall carries evenly spaced chipping cutters. Here, the chipping device moves upwardly from its bottom dead center relative to the feed channel during the chipping operation.

In comparison with a horizontally moving chipping device, the aforedescribed vertically moving chipping device advantageously results in a shortening of the actual chipping section and leads to the advantages disclosed in the first Publication. Notwithstanding the advantages and success derived from the chipping machine of the type disclosed in the first Publication, the following problem may arise in certain arrangements. When the last section to be chipped of a bundle of long timber pieces is introduced, the device does not effectively support or guide all of the timbers of this section into the chipping chamber. The timber pieces of the last section can thus drop into the continuously rotating cutter ring in a more or less uncontrolled manner. Because the timber pieces tilt downward as they drop into the rotating cutter ring, the cutter ring can turn the timber pieces in the opposite direction before the rams, which project into the chipping chamber from the above, can clamp them down.

German publication DE 25 42 340 A1 (hereafter the "second Publication") also discloses a timber chipping machine, but its rotatable cutter ring is stationary. Instead, it uses a timber receiving bin having a movable platform to press the timbers against the various positions of the rotating cutter ring. The movable platform is curved to match the curvature of the rotating cutter ring. The loading bin is aligned with the receiving bin on the open side of the chipping ring and also has a base having a curvature matched to the curvature of the movable platform. The loading bin is pivoted between a vertical position (timber removing) and a tilted position (timber receiving) by a piston/cylinder unit. Here, the conveyor drops the timbers through the tilted loading bin's upper opening, which is positioned below the downstream end of a conveyor. After the loading is completed, the loading bin is pivoted into its vertical unloading position. A discharge pusher pushes the timber from the loading bin into the receiving bin and thus onto the curved platform. After the pusher is withdrawn, the platform is raised continuously via a piston/cylinder unit to bring the timber into engagement with the rotating cutters.

The chipping machine type disclosed in the second Publication has shortcomings too in that it is not feasible for chipping long-length timbers. Rather, it is severely limited to a relative short timber (the length substantially the same as or shorter than the chipping cutter length.

Accordingly, there is a need for a long-timber chipping machine without the aforementioned shortcomings associated with the known timber chipping devices. The present invention fulfills this need.

SUMMARY OF THE INVENTION

The present invention is drawn to a long-timber chipping machine, with a vertically movable chipping device. According to the present invention, the long-timber chipping machine has a timber feed channel for receiving timbers to be chipped. The base of the feed channel is convexly curved. A vertically displaceable chipping device is positioned adjacent the downstream end of the timber feed channel. The chipping device includes a rotatable cutter ring having chipping cutters on its cylindrical inner wall, which defines a chipping chamber that is aligned with the downstream end of the timber feed channel. Preferably a housing is provided to shield at least the circumferential peripheral side and back of the cutter ring. The back wall of the housing together with the cylindrical inner wall defines the chipping chamber, where the timbers are advanced thereinto using a conventional timber-advancing device.

A convexly curved timber-receiving plate is fixedly positioned relative to the feed channel and spans from the timber feed channel into the chipping chamber. This plate is also convexly curved to match the curvature of the cutter ring's upper cylindrical inner wall and is aligned with the convexly curved base of the feed channel. During the chipping operation, the chipping device is lowered while the timber receiving plate remains stationary.

Preferably, when the cutter ring is located in its top dead center, the position where the timbers are introduced into the chamber, the vertical clearance spanning from the upper cylindrical inner wall of the cutter ring to the curved feed channel base is greater than the maximum filling height of the feed channel. A pair of vertical side walls preferably are included to contain the timbers. Specifically, the side walls are fixedly connected to the chipping device, preferably the housing. The side walls preferably extend into the chipping chamber and are spaced apart about the width of the plate to allow the side walls to move as the chipping device is moved vertically. Preferably, the side walls slideably rest against both sides of the plate over the vertical displacement of the chipping device. The side walls are generally aligned with the feed channel when the timbers are introduced into the chipping chamber.

The chipping machine preferably includes at least one vertically adjustable rams arranged outside the chipping device for pressing down on the timbers during chipping. Vertically displacing means, such as lifting cylinders, can be used to vertically move the chipping device. In addition, the lifting means can also include guides for vertically guiding the chipping device.

The chipping device preferably includes an extraction duct for extracting wood chips, using suction for example. The duct can be placed anywhere around the housing, but preferably is connected to the upper portion of the housing. In this regard, compressed-air nozzles directed into the housing can also be included to expedite wood chip extraction. The nozzles can be also positioned anywhere around are housing, but preferably is positioned in the lower part of the housing.

To better align the advancing ends of the timbers, an axially displaceable baffle can be used. The baffle can form a part of the back wall, if desired, which can move toward the advancing timbers.

BRIEF DESCRIPTION OF THE DRAWINGS

These and other features, aspects, and advantages of the present invention will become much more apparent from the following description, appended claims, and accompanying drawings where:

DETAILED DESCRIPTION OF THE PREFERRED EMBODIMENTS

Figure 1:
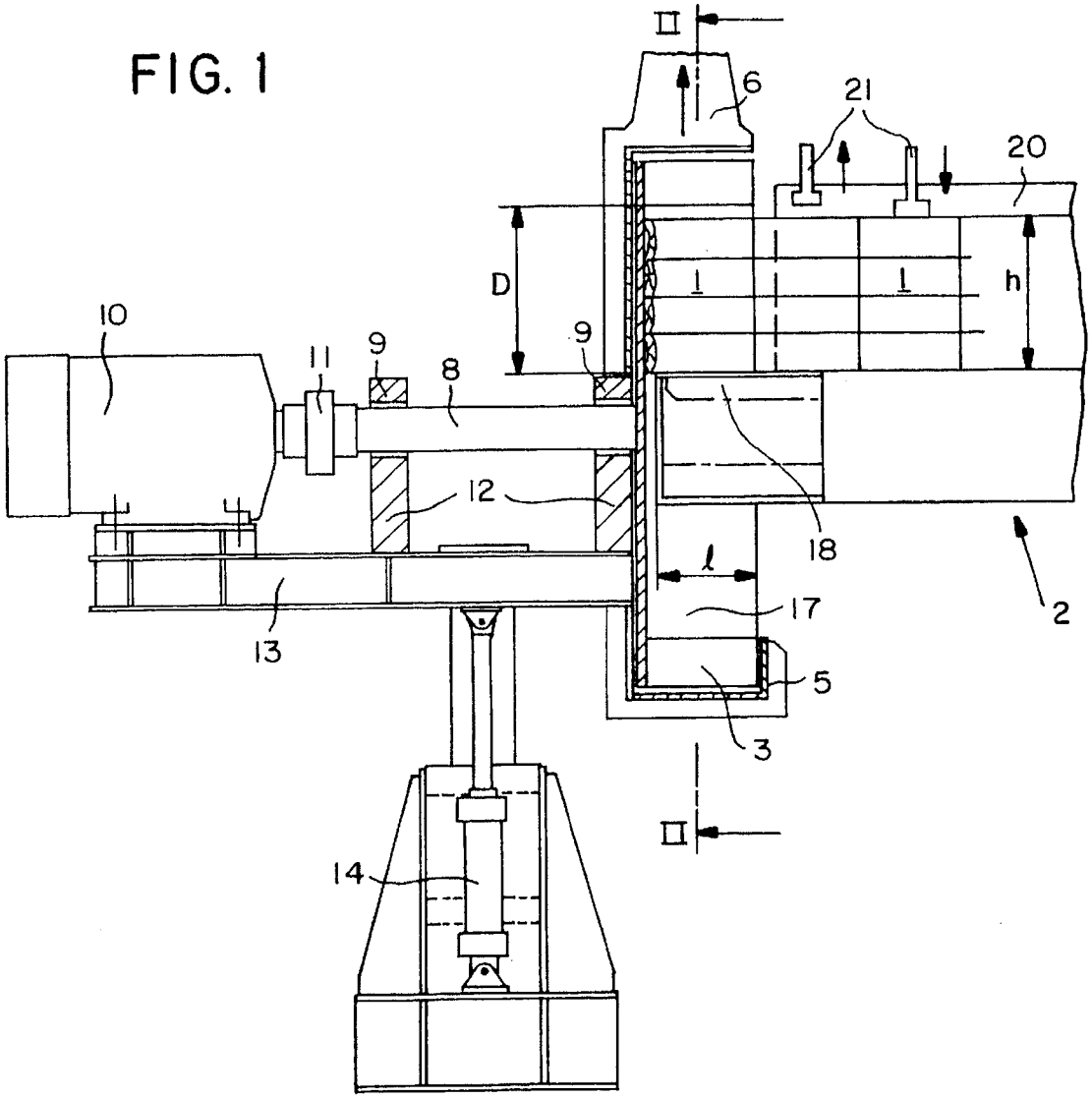
FIG. 1 illustrates a partial side view of a long-timber chipping machine according to the present invention.
Figure 2:
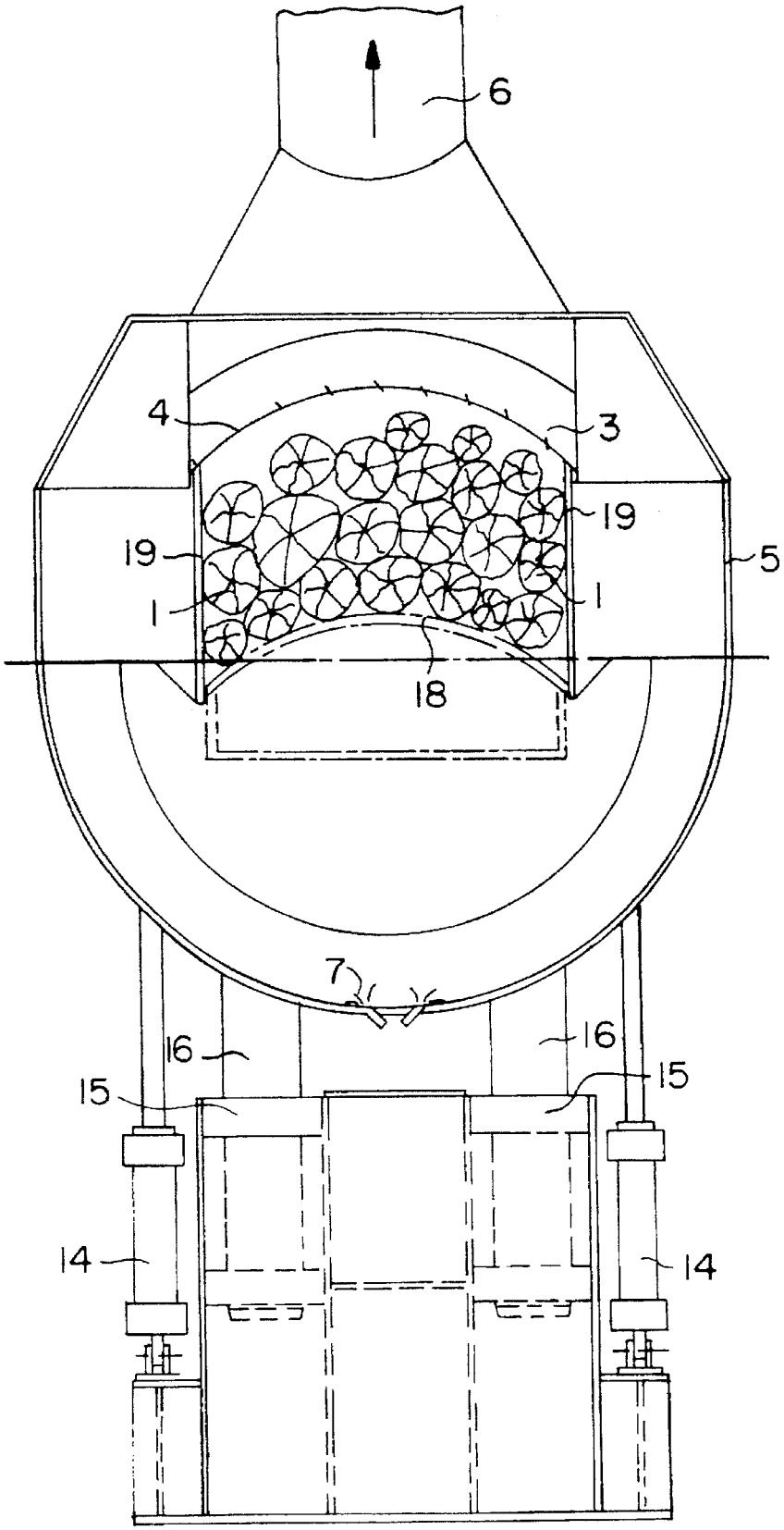
FIG. 2 illustrates a cross-sectional view taken along line 2—2 of FIG. 1.
Figure 3:
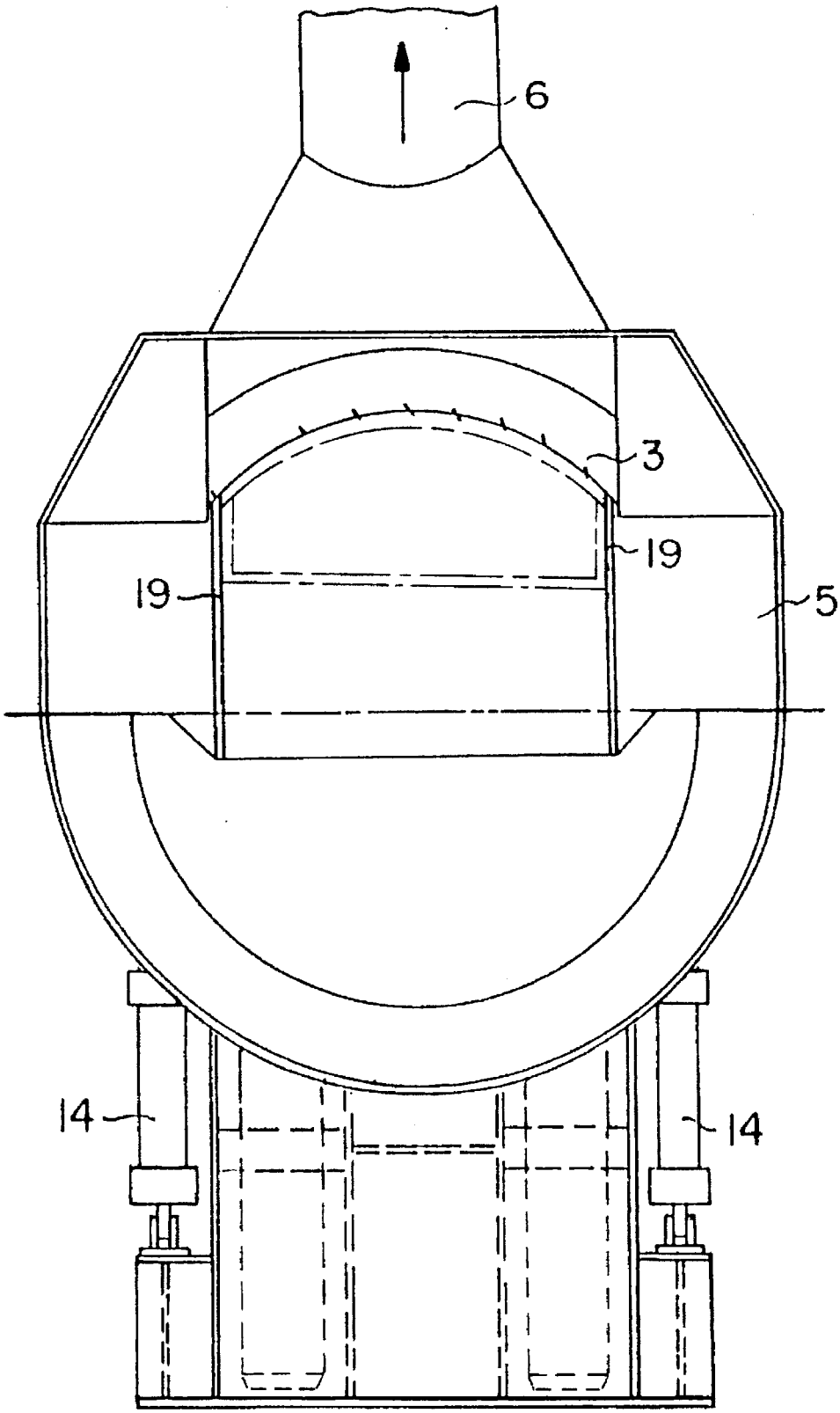
FIG. 3 illustrates a view similar to FIG. 2, but with its chipping device lowered after the chipping operation is completed.

As illustrated in FIGS. 1–3, the long-timber chipping machine according to the present invention includes a timber feed channel 2 for receiving a group of longitudinally arranged timbers 1, which are advanced to a chipping device or tool using a conventional timber advancing device (not shown in detail), such as a plate-type conveying belt or a thrust-action plate, or both. The chipping device, which has a rotatable cutter ring 3 equipped with chipping cutters 4 on its cylindrical inner wall, is positioned at the downstream end of the timber feed channel 2. The cylindrical inner wall defines a chipping chamber 17, which is aligned with the feed channel downstream end. A housing 5 encloses the cutter ring 3 on its outer peripheral side and back (downstream of the timber feed channel 2). Thus, the chipping chamber is also defined by the back wall of the housing. The housing 5 further includes an extraction duct 6 in its upper portion and compressed-air nozzles 7 in its lower portion, which nozzles are directed into the housing interior.

The cutter ring 3 is coaxially and collinearly mounted to a drive shaft 8, which is rotatably journalled in bearing blocks 12, in bearings 9. A motor 10 rotates the drive shaft 8 and thus the cutter ring 3. An intermediate clutch 11 is coupled to the motor and the drive shaft to control the cutter ring rotation. The motor 10 and the bearing blocks 12 are fixedly fastened to a vertically movable platform 13 supported on a lifting device. As better shown in FIG. 2, the lifting device includes a pair of lifting cylinders 14 and a pair of relatively larger diameter guides 15 for vertically, slideably supporting a complementary pair of guide rods 16 fixedly fastened to the platform 13.

FIGS. 1 and 2 illustrate the chipping machine before the beginning of the chipping operation, with its lifting cylinders 14 extended upwardly. The chipping device is thus located in its upper, top dead center at the initiation of the chipping operation. In this position, the timbers 1 located in the timber feed channel 2 can be advanced into the chipping chamber 17 without interference from the cutter ring 3. According to the present invention, a timber-receiving plate 18 is fixedly positioned relative to the cutter ring 3, such as by connecting the same to the timber feed channel or the base 2*a* thereof, or any other stationary member. The plate 18 spans from the feed channel 2 and projects into the chipping chamber 17 over the axial length "l" thereof as shown in FIG. 1. This plate 18 has a convex curve (cross sectional), matching the curvature of the upper cylindrical inner wall of the cutter ring 3. Further, the plate 18 is aligned with the base 2*a* of the timber feed channel 2, which base also has a substantially same convex curvature. If the chipping device is located in its top dead center (FIG. 1 and 2), then the vertical clearance "a" from the upper cylindrical inner wall of the cutter ring 3 to the timber-receiving plate 18 corresponds at least to the feed channel's maximum filling capacity height h, preferably greater.

Two vertical side walls 19 are fixedly connected to the housing 5 of the chipping device and project into the chipping chamber 17, with the walls 19 resting on or positioned closely adjacent to the lateral side ends of the timber-receiving plate 18. As the chipping device moves vertically, the side ends of the plate 18 slide or otherwise permit the plate to pass therethrough. When the chipping device is in its top dead center (FIGS. 1 and 2), the side walls 19 are approximately vertically aligned with the longitudinal walls 20 of the timber feed channel 2.

Vertically adjustable rams 21 are arranged outside the chipping tool, which rams press on the timbers 1 from the above to hold them in place against the plate 18 and the feed channel 2 during the chipping operation. Since the timber-receiving plate 18 is fixedly positioned, the timbers resting on the plate 18 is maintained in place, the side walls also confining them during the chipping operation.

In operation, the chipping device is raised to its top dead center, as illustrated in FIGS. 1 and 2. The timbers 1 are advanced into the chipping chamber until the downstream ends of the timbers 1 rest on the housing back wall or is near the back wall, as shown in FIG. 1. In this regard, to achieve even better timber guidance while the downstream ends of the timbers are displaced into the chipping chamber, it may be expedient to includes an axially displaceable baffle, which can form the rear wall of the chipping chamber (or is placed adjacent to the back wall) facing the timber feed channel, as described in the aforementioned first Publication, the disclosure of which incorporated herein by reference. The rams 21 are lowered on the timber resting on the feed channel 2. As the chipper ring 3 is rotated, the piston rods of the lifting cylinders 14 are retracted, lowering the timber-chipping device relative to the stationary timber-receiving plate 18 and the feed channel 2. As the chipping device is lowered, the timbers 1 projecting into the chipping chamber 17 are chipped by the continuously rotating cutter ring 3. The wood chips are then extracted away from the chipping device through the extraction duct 6 (using vacuum) and compressed air blown through the compressed-air nozzles 7 positioned at a lower region of the housing 5, as shown in FIG. 2.

FIG. 3 illustrates the position of the chipping device at the end of the chipping operation, where the chipping device is at its bottom dead center. At this position, the two side walls 19 now extend downwardly relatively from the timber-receiving plate 18. The upper cylindrical inner wall of the cutter ring 3, with its chipping cutters 4, is located directly above the timber-receiving plate 18, with an extremely small clearance so that all of the timbers located on the timber-receiving plate 18 can be chipped.

The long-timber chipping machine according to the present invention thus overcomes the aforedescribed shortcomings. Specifically, the present chipping machine enables chipping of long timbers, while holding the timbers fed to the chipping device. Even when the remaining timbers are short, the plate 18 stably supports them. The present invention thus enjoys all the advantages and benefits obtained from the vertically moving chipping device and the short-timber chipping device, where the timbers are stably held against the cutting ring to prevent the timbers from contacting the rotating cutter ring before they are completely introduced into the chipping chamber. The stationary timber-receiving plate prevents pieces of timber from dropping into the rotating cutter ring and the convex cross-sectional design of the timber-receiving plate guarantees that all of the timbers are chipped. The side walls, which slide vertically along the longitudinal borders of the timber-receiving plate 18 during the chipping operation, hold the pushed-in group of timber together and prevent any short timbers from dropping laterally into the rotating cutter ring.

A further advantage over the previously known embodiment described in the introduction is to be seen in the fact that rams which project directly into the chipping chamber can be eliminated without replacement. This also results in a reduction in the overall height.

Given the disclosure of the present invention, one versed in the art would readily appreciate the fact that there may be other embodiments and modifications well within the scope and spirit of the present invention. Accordingly, all expedient modifications readily attainable by one versed in the art from the present disclosure within the scope and spirit of the present invention are to be included as further embodiments of the present invention. The scope of the present invention accordingly is to be defined as set forth in the appended claims.

We claim:

1. A long-timber chipping machine comprising:

a timber feed channel having a convexly curved base for receiving timbers to be chipped, which timbers are adapted to be advanced with a timber-advancing device;

a vertically displaceable chipping device positioned adjacent a downstream end of the timber feed channel, the chipping device including a rotatable cutter ring having chipping cutters on its cylindrical inner wall, wherein the cylindrical inner wall defines a chipping chamber into which the timbers are adapted to be introduced, wherein the chipping chamber is aligned with the downstream end of the timber feed channel; and a convexly curved timber-receiving plate fixedly positioned relative to the feed channel and spanning from the timber feed channel into the chipping chamber, wherein the plate is convexly curved to match the curvature of an upper cylindrical inner wall of the cutter ring and remains aligned with the convexly curved base of the feed channel during chipping, wherein the chipping device is lowered relative to the timber receiving plate to chip the timbers.

2. A long-timber chipping machine according to claim 1, wherein when the cutter ring located in its top dead center, a vertical clearance spanning from the upper cylindrical inner wall of the cutter ring to the curved feed channel base is greater than the maximum filling height of the feed channel.

3. A long-timber chipping machine according to claim 1, further comprising two vertical side walls fixedly connected to the chipping device, wherein the side walls extend into the chipping chamber and are spaced apart about the width of the plate to allow the side walls to move as the chipping device is moved vertically.

4. A long-timber chipping machine according to claim 3, further comprising a housing for shielding at least a circumferential peripheral side and a back of the cutter ring, wherein the chamber is further defined by a back wall of the housing.

5. A long-timber chipping machine according to claim 4, wherein the side walls slideably rest against both sides of the plate over the vertical displacement of the chipping device.

6. A long-timber chipping machine according to claim 3, further comprising at least one vertically adjustable rams arranged outside the chipping device for pressing down on the timbers during chipping.

7. A long-timber chipping machine according to claim 1, further comprising lifting cylinders for vertically moving the chipping device.

8. A long-timber chipping machine according to claim 7, further comprising guides for vertically moving the chipping device.

9. A long-timber chipping machine according to claim 4, further comprising an extraction duct for extracting wood chips, wherein the extraction duct is connected to an upper portion of the housing.

10. A long-timber chipping machine according to claim 9, further comprising compressed-air nozzles directed into the housing, wherein the nozzles are positioned in a lower part of the housing.

11. A long-timber chipping machine according to claim 4, further comprising an axially displaceable baffle, which forms the back wall of the chipping chamber.

12. A long-timber chipping machine comprising:

a timber feed channel having a convexly curved base for receiving timbers to be chipped, which timbers are adapted to be advanced with a timber-advancing device;

a vertically displaceable chipping device positioned adjacent a downstream end of the timber feed channel, the chipping device including a rotatable cutter ring having chipping cutters on its cylindrical inner wall, wherein the cylindrical inner wall defines a chipping chamber into which the timbers are adapted to be introduced, wherein the chipping chamber is aligned with the downstream end of the timber feed channel;

a housing for shielding at least a circumferential peripheral side and a back of the cutter ring, wherein the chamber is further defined by a back wall of the housing;

a convexly curved timber-receiving plate fixedly positioned relative to the feed channel and spanning from the timber feed channel into the chipping chamber, wherein the plate is convexly curved to match the curvature of an upper cylindrical inner wall of the cutter ring and remains aligned with the convexly curved base of the feed channel during chipping, wherein the chipping device is lowered relative to the timber receiving plate to chip the timbers, and wherein when the cutter ring is located in its top dead center, a vertical clearance spanning from the upper cylindrical inner wall of the cutter ring to the curved feed channel base is greater than the maximum filling height of the feed channel; and a pair of vertical side walls fixedly connected to the housing, wherein the side walls extend into the chipping chamber and are spaced apart about the width of the plate to allow the side walls to move as the chipping device is moved vertically, wherein the side walls slideably rest against both sides of the plate over the vertical displacement of the chipping device, and wherein the side walls are approximately aligned with the feed channel while the timbers are introduced into the chipping chamber.

13. A long-timber chipping machine according to claim 12, further comprising at least one vertically adjustable rams arranged outside the chipping device for pressing down on the timbers during chipping.

14. A long-timber chipping machine according to claim 12, further comprising means for vertically moving the chipping device.

15. A long-timber chipping machine according to claim 13, further comprising means for vertically moving the chipping device.

16. A long-timber chipping machine according to claim 12, further comprising an extraction duct connected to an upper portion of the housing for extracting wood chips.

17. A long-timber chipping machine according to claim 16, further comprising compressed-air nozzles directed into the housing.

18. A long-timber chipping machine according to claim 12, further comprising an axially displaceable baffle, which forms the back wall of the chipping chamber.

* * * * *